United States Patent [19]

Ingrain et al.

[11] 4,296,396

[45] Oct. 20, 1981

[54] MANUAL ELECTRIC SWITCH WITH THERMAL RELEASE

[75] Inventors: Raymond A. Ingrain, Quetigny; Jacques Cohen, Fontaine, both of France

[73] Assignee: La Telemecanique Electrique, France

[21] Appl. No.: 116,508

[22] Filed: Jan. 29, 1980

[30] Foreign Application Priority Data

Jan. 31, 1979 [FR] France ..... 79 02479

[51] Int. Cl.[3] ..... H01H 71/16

[52] U.S. Cl. ..... 337/66; 337/58; 337/70

[58] Field of Search ..... 337/70, 66, 75, 59, 337/58; 335/43, 37, 172

[56] References Cited

U.S. PATENT DOCUMENTS 3,930,213 12/1975 Richards ..... 337/70

4,083,027 4/1978 Dobrosielski et al. ..... 337/66

*Primary Examiner*—Harold Broome

*Attorney, Agent, or Firm*—William A. Drucker

[57] ABSTRACT

In a manual switch with thermal and magnetic release, the fixed pivots of a control member, of a latch, and of a transmission member coupled to the contacts, are disposed at the apices of a right-angled triangle, one side bounding the right angle being parallel to the direction of actuation of the control member and to the movement of the contacts, the other side bounding the right angle being placed in the vicinity of the control member.

6 Claims, 6 Drawing Figures

MANUAL ELECTRIC SWITCH WITH THERMAL RELEASE

BACKGROUND OF THE INVENTION

The invention relates to a switch, with manual closing and opening and with thermal release, comprising in a housing an actuating member coupled to a control arm which is movable about a first fixed pivot and the end of which is coupled by a first articulation to a first end of a connecting rod to constitute a knee joint, a second end of the connecting rod being coupled by a second articulation to a loading lever, a first end of which loading lever is abutted against a latch displaced rotatably about a second fixed pivot by the movement of overload bi-metallic strips, a second end of the loading lever co-operating with a transmission lever which is associated with the movable contacts, and pivots about a third pivot. Such known switches can be used both for the closing and for the breaking of monophase circuits and for that of three-phase circuits, in which they must usually carry out the feeding and protection of electric motors.

In this latter case, the presence of three thermal bi-metallic strips makes the apparatus relatively bulky, such that it has been sought to dispose each of these respectively in planes passing through the input and output terminals in order to obtain the minimum width which in practice is imposed by the length of the escape paths between the terminals.

Amongst the measures which can be put to use to obtain a reduced width there can be mentioned those which consist in increasing the height and length of the apparatus, without nevertheless pushing these possibilities too far, because reason of the presence of other apparatus on the control panels.

OBJECT OF THE INVENTION

The object of the invention is to provide an apparatus in accordance with the manner of construction referred to above but in which the height dimension will be principally exploited to accommodate the most bulky mechanical release and loading members; within the scope of the invention, further features will permit the giving to these members of proportions which ensure at the same time a rapid opening, a large stroke for the contacts, as well as a good pressure for these latter, and a moderate locking pressure in order not to compromise the sensitivity of release.

SUMMARY OF THE INVENTION

According to the invention, in such a switch as set forth hereinabove, the first pivot and the second pivot are placed in the vicinity of the upper part of the housing adjacent to the actuating member, whilst the third pivot which is fixed is placed at the lower part, the three pivots being placed substantially at the apices of a right-angled triangle, and the second and third pivots being placed on a straight line substantially parallel to the direction of movement of the actuating member and to the direction of movement of the movable contacts.

The invention will be better understood from the following description made with reference to the accompanying drawings.

DESCRIPTION OF THE PREFERRED EMBODIMENT

Figure 1:
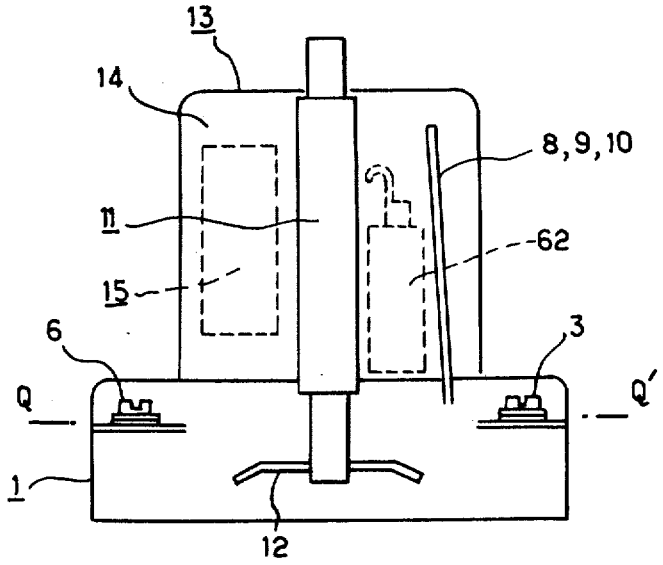
FIG. 1 is a simplified view in elevation of the apparatus of the invention.
Figure 2:
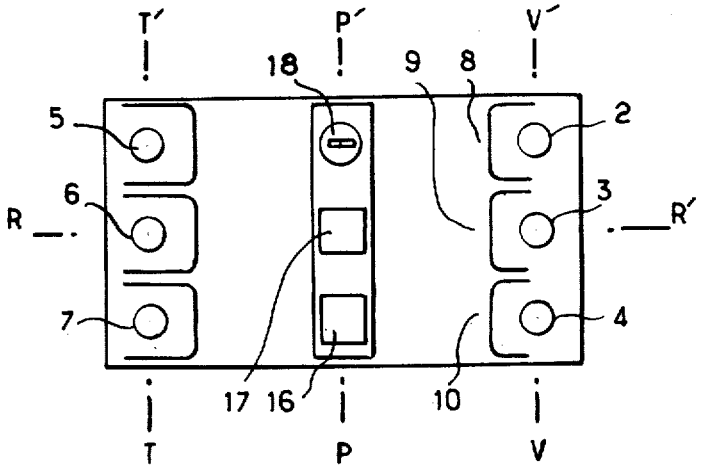
FIG. 2 is a view from above of the apparatus according to FIG. 1.

A switch in accordance with the invention is shown in FIGS. 1 and 2 wherein an insulating base 1 is equipped with input terminals 2, 3, 4 and output terminals 5, 6, 7. On this base there is also fixed a series of thermal bi-metallic strips 8, 9, 10, a housing 11 receiving members to carry out manual closing, and automatic opening in case of overload, and contacts such as 12.

A hood 13 covers the bi-metallic strips and the housing and encloses a space 14 which can receive a magnetic lack-of-voltage releaser 15 likewise intended to cause automatic opening, whilst the space existing between the thermal bi-metallic strips and the housing is occupied by an overload relay 62. Two push buttons 16, 17 serve respectively for the manual opening and closing of the contacts and are situated near to an intensity adjustment member 18, which would be adjusted by the user.

Figure 3:
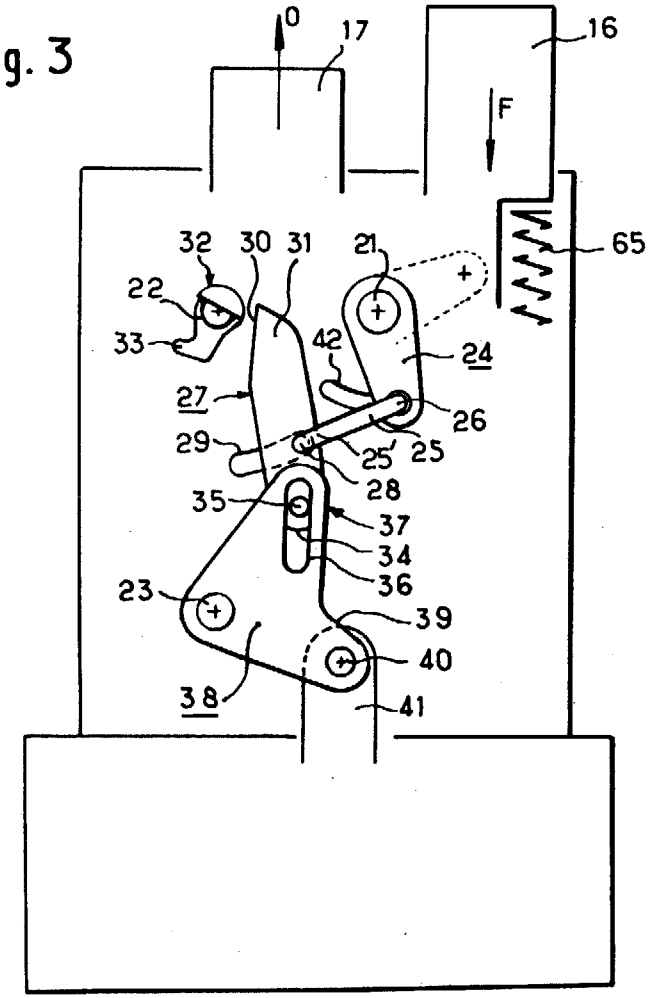
FIG. 3 is a section taken on the plane PP' of the housing containing the members for closing and opening, when the contacts are in the open state.

The flat housing 11 in FIG. 3, seen in a section taken on the plane PP' of FIG. 2, is placed in this plane perpendicularly to the plane QQ' containing the terminals and parallel to the planes TT' and VV' containing respectively the input and output terminals.

With the housing and the bi-metallic strips there is associated a lever 45 which is placed therebetween in order to transmit to the former the movements of the latter. This lever is pivoted on a support 20 fast to the housing 11, see also FIG. 6.

In the housing there are disposed three pivots 21, 22 and 23 the axes of which are perpendicular to the plane P, the first two being placed at the upper part of the housing in the neighbourhood of the push buttons, and the latter being in the lower part of the housing. The first pivot 21 assures the pivoting of a lever 24 which is associated, in a manner not illustrated, with the "stop" push button 17 and the "go" push button 16, this latter being subjected to the action of a spring 65 which urges it upwardly in the drawing.

The lever 24 constitutes the input element of a knee joint which it forms with the small connecting rod 25 to which it is coupled by the pivot 26. This pivot moves in a curvilinear slideway 42 of the housing, serving as a stop means. The end 25' of the connecting rod 25 remote from the pivot 26 and which constitutes the end of the knee joint, carries a second pivot 28 which couples it with a loading lever 27 of which a surface 30, of a first end 31, is placed opposite to a rotary latch 32 which has an actuating tongue 33 and which is pivoted at 22. A second end 34 of this lever carries a lug 35 engaged in a slot 36 formed in an arm 37 of a transmission lever 38, another arm 39 of which is coupled by a pivot 40 to an element 41 which can be a contact carrier or any other element capable of displacing movable contacts such as 12, see also FIG. 1.

An axial extension of the pivot 28 enters a curvilinear slideway 29 centered on the axis 22 and ensuring guiding of the pivot 28.

In the position of the various elements shown in FIG. 3 the push button 16, intended for the closing of the contacts, is not pushed in and accordingly the contacts are open.

Figure 4:
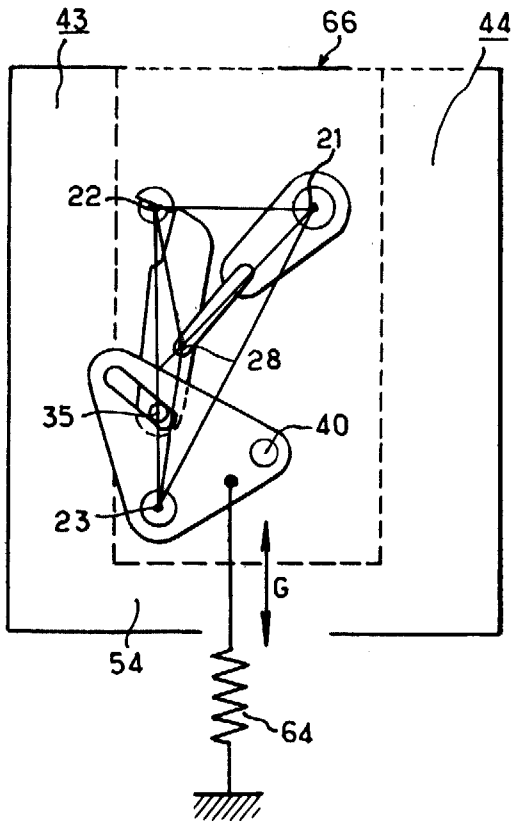
FIG. 4 is a view in section of the housing on the same plane PP' when the contacts are in the closed state.

In the position of the same elements shown in FIG. 4, the push button 16 has been pushed in to alignment with the lever 24 and the connecting rod 25 has caused firstly the displacement to the left of the loading lever, and then the application of the surface 30 against the latch 32, and finally the tilting in reverse direction of the transmission lever 38, which in its turn causes the displacement towards the top of the drawing of the element 41 and consequently the closing of the contacts which are associated therewith.

Figure 5:
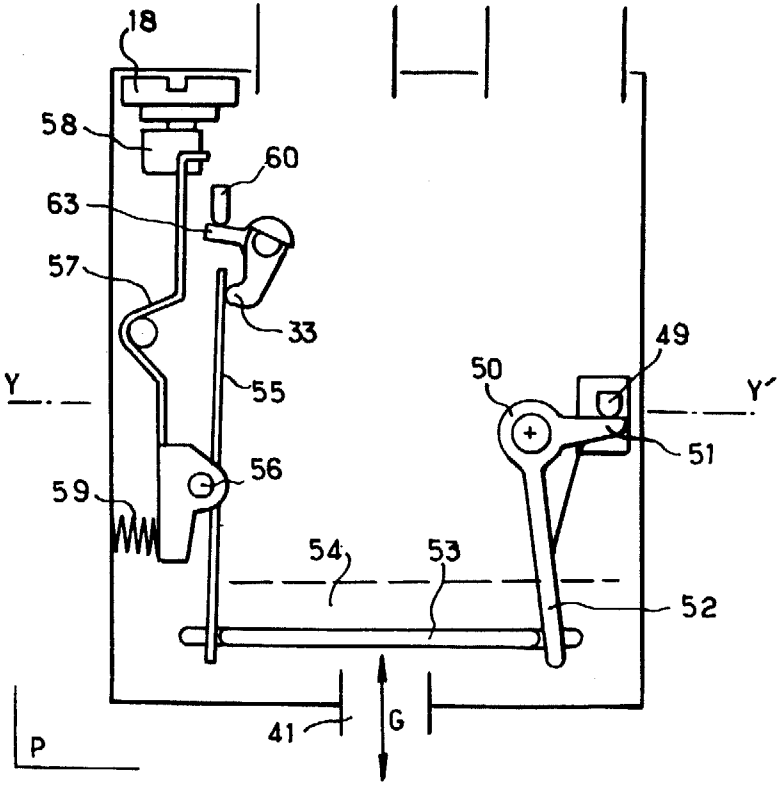
FIG. 5 is a view in section of the housing taken on the plane PP' and in which the closing and opening members have been removed, and in which there have been shown the members necessary for the transmission of the movement of the thermal bi-metallic strips and of the magnetic relay.

The disposition of the various fixed pivots 21, 22, 23, seen in FIG. 4, has been designed such that the movable elements occupy a small space in the transverse direction with respect to the pivots, and to permit the leaving in two portions of lateral chamber 43 and 44 a space such that the members for adjustment of intensity and the compensating bi-metallic strip, seen in FIG. 5, can be disposed in the first portion 43, and such that the means for transmission of the movements of the thermal bi-metallic strips and/or of the overload relay shown in the figure can be housed in the second portion 44, a third portion 54 placed in the base of the housing permitting the passage of a tumbler 53.

This arrangement is such that the triangle passing through the pivots 21, 22, 23 is substantially a right-angled triangle, the hypotenuse of which passes through 21 and 23, and of which the perpendicular sides are one 22, 23 parallel to the direction G of movement of the contact carrier 41, and the other 21, 22 substantially parallel to the upper surface 66 of the housing.

The direction G is moreover parallel to the direction of actuation F and O of the push buttons 16 and 17.

In the position illustrated in FIG. 4, it will be seen that the straight line passing through the pivot 21 and through the pivot 28 substantially represents the median terminating at the side 22, 23 of the triangle defined above, because substantially equal distances separate 28 from 22 and from 23, whilst the pivot 28 is near to the straight line passing through 22 and 23.

The choice of proportions indicated is useful, on the one hand, in regard to the pressure for applying the loading lever 27 with a moderate force on the pivoting latch 32, which would not be the case if the pivot 28 was too close to the same and, on the other hand, in regard to the desirability of reducing the effects of inertia of the loading lever at the moment of automatic opening, which would not be obtained if the pivot 28 were too close to the pivot 23; in this latter case, the spaces necessary for the displacement of the knee joint and of the loading lever would furthermore be found to be very disadvantageous.

Moreover, for this particular position of the pivot 28 the position of the lug 35 has an influence on the force of application of the loading lever on the latch and on the stroke of the contact carrier 41. Good results have been obtained by disposing the lug and the slot in such a manner that, on the one hand, the distance which separates it from the pivot 22 shall be about double that which separates it from the pivot 23, and on the other hand the slot shall not be aligned with the third pivot 23.

Figure 6:
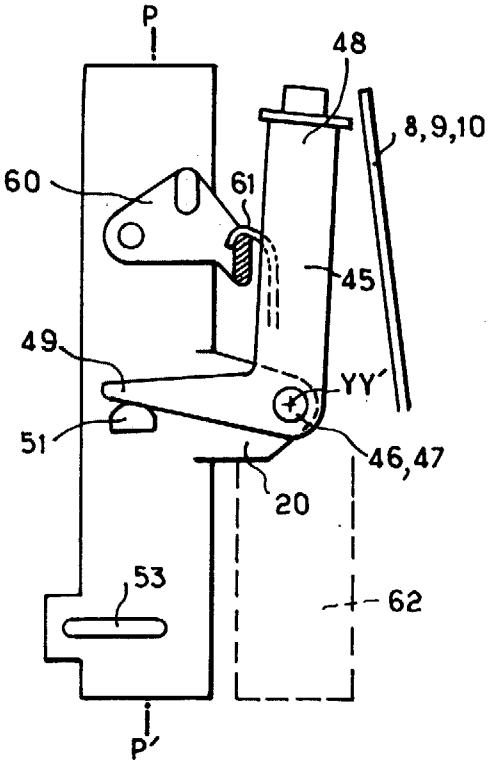
FIG. 6 is a partial section of the housing, taken on the plane RR' of FIG. 2, in which there are shown the external members for transmission of the movements resulting from the thermal bi-metallic strips and from the overload relay.

The transmission of the movement of the thermal bi-metallic strips is obtained by a lever 45 which is pivoted on two bearings 46, 47 which are carried by supports such as 20 and are placed externally of the housing, and of which the axis YY′ is parallel to the planes PP′ and QQ′, see FIG. 6 and FIG. 2. A first end of this lever 48 is in contact with the thermal bi-metallic strips and a second end 49 enters into an opening in the housing to transmit its movements to a kinematic chain comprising a lever 50 with two arms 51, 52 at right angles placed in the space 44, a tumbler 53 placed perpendicularly to the direction G in the lower region 54 of the housing, and a compensating bi-metallic strip 55 which can pivot about a pivot 56 carried by an adjusting lever 57, the position of which is determined by a cam 58 constituting the means for adjustment of the intensity of release and of which the application on this cam is obtained by a return spring 59; these latter elements are disposed in the space 43 in such a manner that the compensating bi-metallic strip is substantially parallel to the straight line passing through the pivots 22 and 23 and can cooperate with the tongue 33, see FIG. 5.

Through another window of the housing, not shown, a second lever 60 displaced by the arm 61 of the intensity relay 62 acts directly on the arm 63 of the latch 32, in order to cause release, see FIGS. 5 and 6.

During a release, the latch 32 performs a slight rotation which permits the surface 30 to escape from it; the loading lever firstly pivots about the pivot 28 in the reverse direction under the effect of a couple which is transferred to it by the transmission lever 38 which is itself associated with a return spring such as 64, and then performs a return movement which is imposed on it by the pivot 28 when the knee joint takes up again the position shown in FIG. 3 under the effect of the return spring 64.

We claim:

1. In a switch, with manual closing and opening and with thermal release, having a housing, an operating member in the housing and coupled to a control arm which is movable about a first fixed pivot and an end of which is coupled by a first articulation to a first end of a connecting rod to constitute a knee joint, a second end of said connecting rod being coupled by a second articulation to a loading lever, a first end of which loading lever is abutted on a latch displaced rotatably about a second fixed pivot, by the movement of overload bi-metallic strips, and a second end of which loading lever cooperates with a transmission lever which is associated with movable contacts, and which pivots about a third pivot, the improvement that:

(i) the first pivot and the second pivot are disposed in the proximity of an upper part of said housing near to said operating member, (ii) said third pivot is fixed and disposed at the lower part, (iii) said three pivots are placed substantially at the apices of a right-angled triangle, and (iv) said second and third pivots are placed on a straight line substantially parallel to the direction of movement of said operating member and to the direction of movement of said movable contacts.

2. A switch, according to claim 1, wherein coupling between the second end of the connecting rod and the loading lever is obtained by an articulation guided in a curved slideway of the housing concentric with the second pivot, the second end of the said loading lever carrying a lug which moves in a slot of the transmission lever which is not aligned with the third pivot.

3. A switch, according to claim 2, wherein the articulation coupling the transmission lever and the end of the connecting rod is situated substantially at equal distances from the second and third fixed pivots when the knee joint is in a working position, in order that the said loading lever is applied against the latch and the contacts are closed.

4. A switch, according to claim 3, wherein the distance separating the lug of the loading lever from the second pivot is substantially equal to twice the distance separating the said lug from the third pivot.

5. A switch, according to claim 2 or claim 3 or claim 4, wherein the space occupied by the knee joint, the latch and the levers is placed between two lateral chambers of a housing receiving, in one chamber thereof, a compensation bi-metallic strip and an intensity control device, and in the other chamber thereof a lever associated with an external lever displaced by the thermal bi-metallic strips, the elements of said two chambers being coupled by a tumbler disposed in a space of the lower part of said housing.

6. A switch, according to claim 1, wherein the knee joint, the loading lever, the transmission lever, and the compensating bi-metallic strip which cooperate with the latch move substantially in a same plane constituting substantially the plane of symmetry of a removable flat housing, and wherein thermal bi-metallic strips are placed parallel to the said plane and externally of said housing, and wherein a lever common to the thermal bi-metallic strips pivots about an axis parallel to said plane and transmits its movement to said lever, said lever and at least one intensity relay being placed between the housing and the said thermal bi-metallic strips.

* * * * *